US007603803B2

(12) United States Patent
Wheeler et al.

(10) Patent No.: US 7,603,803 B2
(45) Date of Patent: Oct. 20, 2009

(54) HANGTAG WITH TOOL SECURING MECHANISM

(75) Inventors: Thomas J. Wheeler, Pomona, CA (US); Iiya Gontar, Reseda, CA (US)

(73) Assignee: Olympia Group, Inc., City of Industry, CA (US)

( * ) Notice: Subject to any disclaimer, the term of this patent is extended or adjusted under 35 U.S.C. 154(b) by 386 days.

(21) Appl. No.: 11/582,514

(22) Filed: Oct. 17, 2006

(65) Prior Publication Data

US 2007/0114148 A1 May 24, 2007

Related U.S. Application Data

(63) Continuation of application No. 10/458,065, filed on Jun. 10, 2003, now Pat. No. 7,121,031.

(51) Int. Cl.
*B65D 73/00* (2006.01)

(52) U.S. Cl. ..... 40/617; 40/673; 211/70.6; 248/309.1; 206/378

(58) Field of Classification Search ..... 40/673, 40/378, 617; 206/493, 378, 806, 349; 211/70.6; 248/314, 309.1
See application file for complete search history.

(56) References Cited

U.S. PATENT DOCUMENTS

| | | | | |
|---|---|---|---|---|
| 3,354,915 | A | 11/1967 | Johnson | |
| 3,568,853 | A | 3/1971 | Feibelman | |
| D227,229 | S | 6/1973 | Funahashi | |
| D249,639 | S | 9/1978 | Hogg | |
| 4,433,498 | A | 2/1984 | Bienz | |
| 4,514,178 | A | 4/1985 | Noto | |
| D282,118 | S | 1/1986 | Mengwasser | |
| D297,651 | S | 9/1988 | Merl | |
| 4,944,389 | A | 7/1990 | Robertson | |
| D314,984 | S | 2/1991 | Hass | |
| 5,044,591 | A * | 9/1991 | Huang | 248/317 |
| D327,507 | S | 6/1992 | Wahl | |
| 5,129,617 | A | 7/1992 | MacWilliamson | |
| D370,174 | S | 5/1996 | Bergstedt | |
| D374,462 | S | 10/1996 | Tyler | |
| 5,728,440 | A | 3/1998 | Good | |
| 5,785,174 | A | 7/1998 | Chow | |
| 5,975,297 | A | 11/1999 | Kao | |
| 6,032,797 | A | 3/2000 | Kao | |
| 6,036,064 | A | 3/2000 | Tawil | |
| 6,102,199 | A | 8/2000 | Ho | |
| 6,197,396 | B1 | 3/2001 | Haas | |
| 6,267,152 | B1 | 7/2001 | Doerr | |
| 6,273,255 | B1 | 8/2001 | Rosler | |
| 6,363,358 | B1 | 3/2002 | Palmer | |
| 6,378,700 | B1 | 4/2002 | Tong | |
| 6,409,015 | B1 | 6/2002 | Hu | |

(Continued)

*Primary Examiner*—Cassandra Davis
(74) *Attorney, Agent, or Firm*—Edmonds Nolte, PC

(57) ABSTRACT

A hangtag is provided that is capable of hanging and securing a tool, such as a socket. The hangtag has a body portion having a front surface and a back surface, a hanging mechanism connected to the body portion, and a tool supporting mechanism also connected to the body portion for supporting a tool. The tool supporting mechanism includes first and second legs and a locking finger disposed between the first and second legs. The locking mechanism allows the particular tool to be reattached to the hangtag assembly after it is initially unlocked. This allows the hangtag to function as a storage and organization device for the tool.

18 Claims, 7 Drawing Sheets

U.S. PATENT DOCUMENTS 6,425,482 B1 7/2002 Chiang
6,536,611 B2 3/2003 Chen
6,581,894 B1 6/2003 Tong
6,634,501 B2 10/2003 Su
6,672,555 B2 1/2004 Chang
6,679,379 B1 * 1/2004 Kao ..... 206/349
6,704,749 B2 3/2004 Palmer
7,111,422 B2 9/2006 Wheeler
7,121,031 B2 10/2006 Wheeler
7,210,663 B2 5/2007 Wheeler
7,264,213 B2 * 9/2007 Liu ..... 248/309.1
2002/0010693 A1 1/2002 Palmer
2002/0105899 A1 8/2002 Lin
2003/0029756 A1 2/2003 Vasudeva
2003/0070949 A1 4/2003 Harris
2003/0200689 A1 10/2003 Cohon
2004/0031710 A1 2/2004 Esme
2004/0250455 A1 12/2004 Wheeler
2004/0256262 A1 12/2004 Wheeler
2004/0256530 A1 12/2004 Wheeler
2005/0005485 A1 1/2005 Wheeler
2005/0067307 A1 3/2005 Kao
2005/0178037 A1 8/2005 Kunreuther
2005/0189368 A1 9/2005 Osterberg
2005/0224673 A1 10/2005 Wang
2005/0224678 A1 10/2005 Wang
2005/0230587 A1 * 10/2005 Yang ..... 248/314
2006/0141195 A1 6/2006 Haroutoonian
2006/0155565 A1 7/2006 Polevoy
2007/0074435 A1 4/2007 Wheeler

* cited by examiner

HANGTAG WITH TOOL SECURING MECHANISM

CROSS REFERENCE TO RELATED APPLICATIONS

This application is a continuation of co-pending U.S. patent application having Ser. No. 10/458,065, filed on Jun. 10, 2003, which is incorporated herein by reference.

BACKGROUND OF THE INVENTION

1. Field of the Invention

The present invention generally relates to tools and tool accessories. The invention more particularly relates to hangtags for supporting and displaying tools. Still further, the invention pertains to a hangtag mechanism that includes a locking mechanism for securing female drive tools such as sockets and socket accessories.

2. Description of the Related Art

In the tool industry, it is desirable to display tools in an organized and presentable manner. One way in which this has been done is through the use of hangtags. Hangtags allow individual tools to be supported and displayed.

FIG. 1 provides a perspective view of an exemplary socket tool 10 that may be hung from a hangtag assembly. In operation, sockets 10 are typically attached to an end of a socket wrench (not shown) and configured to tightly fit around and rotate a nut, bolt, or other type of fastener (not shown) in a deep or narrow recess. As shown, the socket 10 includes a square drive opening 12 disposed at an upper portion thereof. At least one undercut 13 is disposed on an inner surface 14 of the socket 10 adjacent the square drive opening 12. The portion of the inner surface 14 wherein the undercuts 13 are disposed typically has a planar profile and includes four sides, thereby forming the square drive opening 12, as shown in FIG. 1. Generally, an undercut 13 is disposed on each of the four sides of the inner surface 14 adjacent the square drive opening. The undercuts 13 allow the socket wrench to engage the socket 10 and allow the socket 10 to rotate relative to the rotation of the socket wrench.

It is known to attach tools to a hangtag as a means of retail display. However, an apparatus has not heretofore been provided for hanging sockets, such as the socket 10 shown in FIG. 1, in a secure manner. Therefore, a need exists for a hangtag having a securing or locking mechanism for securely supporting a socket in such a manner that a large amount of force is required to detach the tool from the hangtag. Difficultly in releasing the tool from the locking mechanism without a specialized tool is desired to reduce the chances of the tool inadvertently being released from the hangtag, and to reduce theft.

Therefore, there is a need for an improved hangtag assembly with a tool locking mechanism. Further, there is a need for an improved tool locking mechanism that securely attaches a tool to a hangtag assembly, and can be reattached after the tool is "unlocked".

SUMMARY OF THE INVENTION

The present invention provides methods and apparatus for supporting and displaying a tool from a hangtag assembly. More particularly, the invention pertains to a hangtag mechanism that includes a locking mechanism for securing a female drive tool. An example is a socket.

In one embodiment of the present invention, a hangtag assembly first includes a body portion having a front surface and a back surface. A hanging mechanism is connected to the body portion to allow the hangtag assembly to be hung from a display wall, for example. Typically, the hanging mechanism is attached at the top of the body portion of the hangtag. A tool supporting mechanism is also connected to the body portion. The tool supporting mechanism includes first and second legs, wherein the first and second legs each have an inner surface and an outer surface. The tool supporting mechanism also includes a locking finger disposed along the inner surface of the first leg, wherein the locking finger is moveable from a first locking position to a second releasing position.

A method of hanging a tool from a hangtag assembly according to one embodiment of the present invention is also provided. A tool is hung from a hangtag assembly by first providing a tool supporting mechanism on a portion of the hangtag assembly. The tool supporting mechanism includes a first leg and a second leg, wherein the first and second legs each have an inner surface and an outer surface.

The tool supporting mechanism also includes a slot, and a locking finger disposed along the inner surface of the first leg, wherein the locking finger is moveable from a first locking position to a second releasing position. An assembly instrument is then inserted into the slot, thereby contacting the locking finger and urging the locking finger into the second position. The first and second legs and the locking finger are then inserted into the female opening of the tool, e.g., socket. The first and second legs are then engaged against an inner surface of the socket. Finally, the assembly tool is removed from the slot, thereby allowing the locking finger to return to the first locking position whereby the locking finger prevents the first and second legs from bending towards each other.

BRIEF DESCRIPTION OF THE DRAWINGS

So that the manner in which the above recited features of the present invention can be understood in detail, a more particular description of the invention, briefly summarized above, may be had by reference to the appended drawings (FIGS. 2-6 and 7A-C). It is to be noted, however, that the appended drawings illustrate only typical embodiments of this invention and are therefore not to be considered limiting of its scope.

DETAILED DESCRIPTION

Figure 1:
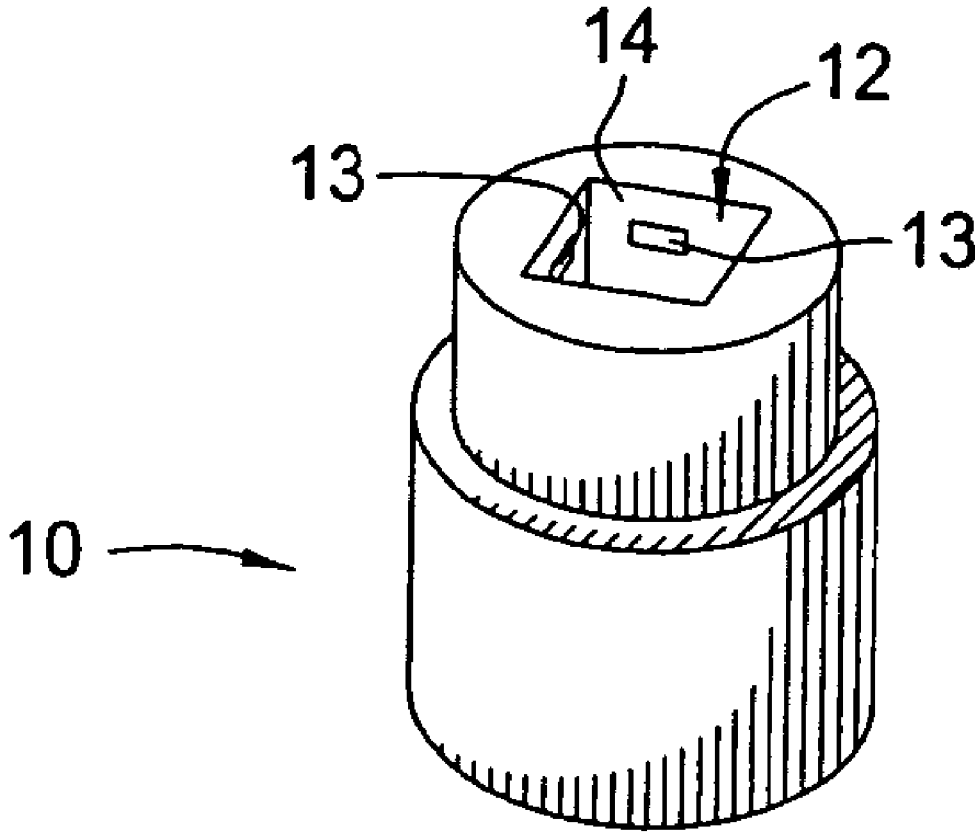
FIG. 1 Prior Art
FIG. 1 provides a perspective view of a single tool product according to one or more embodiments described.

Embodiments of the present invention generally relate to an apparatus for supporting a tool 10, such as socket 10 from FIG. 1, on a hangtag assembly 50. Particularly, embodiments of the present invention relate to a locking mechanism 20 for temporarily securing a socket 10 to a hangtag assembly 50.

Figure 2:
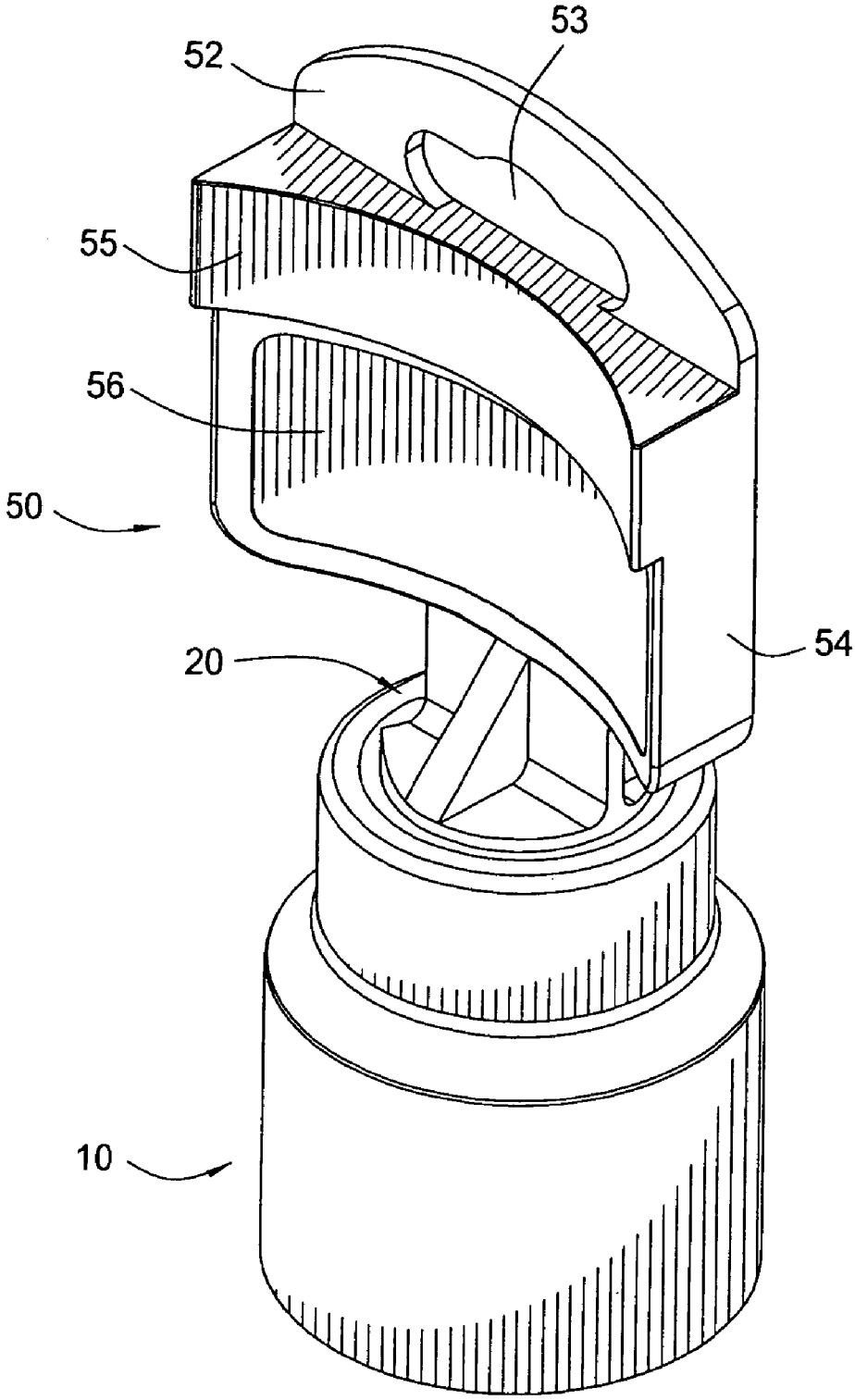
FIG. 2 presents a perspective frontal view of a hangtag as might be used to support and display a single tool product. A tool securing mechanism is shown on the hangtag supporting an exemplary socket.

FIG. 2 presents a perspective frontal view of a hangtag 50 that can be used to support and display a single tool product. The hangtag 50 shown in FIG. 2 has been recently developed by Olympia Group, Inc. The hangtag 50 first comprises a main body 54. The body 54 is generally planar, but optionally includes an upper concave portion 55 for displaying a first label. The upper concave portion 55 provides an attractive, ornamental labeling surface. Typically, the first label will present the house mark under which the tool product is sold. The body 54 may optionally also include a lower concave portion 56. The lower concave portion allows a label describing the product 10 itself to be affixed in an ornamental and pleasing manner.

In the exemplary hangtag 50 of FIG. 2, the product 10 is a socket. The socket 10 is supported by a tool locking mechanism 20. The tool locking mechanism 20 allows the tool 10 to be securely held to the hangtag 50 in a retail environment, but to be detached from the hangtag 50 once the tool 10 has been purchased by a customer.

At the top of the body 54, a hanging mechanism 52 is provided. The hanging mechanism 52 includes a through-opening 53 for receiving a hook (not shown). The hook, in turn, would be attached to a display panel (also not shown). In practice, a number of hooks are disposed along a display panel, permitting various hangtags 50 supporting various products 10 to be presented to the customer in a retail environment.

Figure 3:
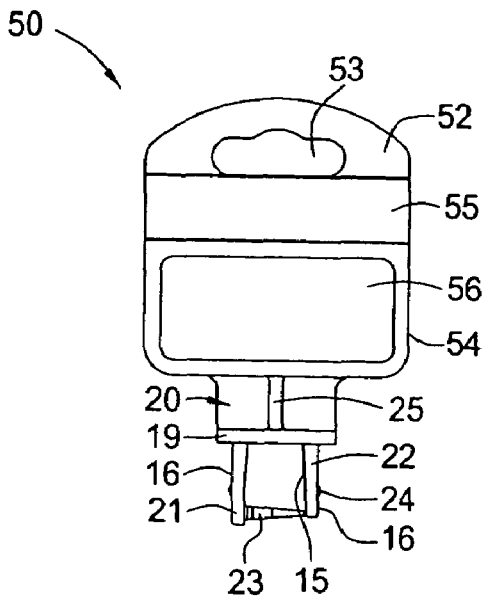
FIG. 3 provides an elevational front view of a hangtag assembly and locking mechanism according to one embodiment of the present invention. In this view, the socket of FIG. 2 is not shown.

FIG. 3 provides an elevational view of a front side of a hangtag assembly 50 and locking mechanism 20 according to one embodiment of the present invention. The locking mechanism 20 is disposed at a lower portion of the hangtag assembly 50. As shown in FIG. 3, the locking mechanism 20 is designed to secure a socket or a nut-driver tool 10; however, it is assumed that other tools with a socket-style end or a square socket drive can be secured by the locking mechanism 20.

The locking mechanism 20 generally includes a planar support member 19, a first leg 21, and a second leg 22. The two legs 21, 22 are disposed on the member 19 and protrude in a direction substantially normal to the surface of the planar support member 19. Each of the legs 21, 22 includes an inner surface 15 and an opposite outer surface 16. Each leg 21, 22 also includes a protrusion or "detent" 24 disposed on its outer surface 16 thereof. The detents 24 extend outward from the legs 21, 22. The detents 24 on legs 21, 22 are positioned at the same relative axial position and 180 degrees radially apart from each other. In one embodiment of the invention, one of the legs, e.g., leg 22, is designed as a leaf spring. The leaf spring characteristics allow the leg 22 to bend inwards without undergoing plastic deformation in order to allow the detents 24 to fit into the socket tool 10 and extend into place once the detents 24 are positioned adjacent to the undercuts 13 on the inner surface 14 of the socket tool 10. It is understood that the term "undercut" includes any hole or indentation for receiving a detent 24. The first leg 21 preferably is not designed as a leaf spring; however, the leg 21 may rely on plastic deformation to a small extent to allow its respective detent 24 to also fit into the undercut 13 on the socket tool 10. In another arrangement, the first leg 21 also serves as a leaf spring, allowing both legs 21, 22 to deflect roughly the amount that one detent 24 protrudes from its outer surface.

As shown in FIG. 3, one of the legs, e.g., the first leg 21, includes a locking spring finger 23. In one arrangement, the locking finger 23 resides along the inner surface 15 of the first leg 21. The finger 23 is dimensioned to contact the inner surface 15 of the opposed second leg 22. In this manner, the locking finger 23 acts as a compression beam to prevent the first and second legs 21, 22 from bending inwards relative to each other. The spring finger 23, like the legs, is designed as a leaf spring member. At least the second leg 22 and the spring finger 23 have a tapered end to enhance their leaf spring characteristics by allowing easier movement of the legs 21 and 22 and the spring finger 23 relative to each other.

In one embodiment, the first leg 21 is configured to be longer than the second leg 22. This configuration allows the spring finger 23, which, as shown in FIG. 3, protrudes from the first leg 21 towards the second leg 22, to contact the second leg 22 at its end furthest from the support member 19. Accordingly, this design minimizes the distance that the spring finger 23 must be forced downward to allow the second leg 22 to bend towards the first leg 21. While the spring finger 23 is in contact with or engaged with the second leg 22, the legs 21, 22 will not be allowed to bend towards each other.

Figure 4:
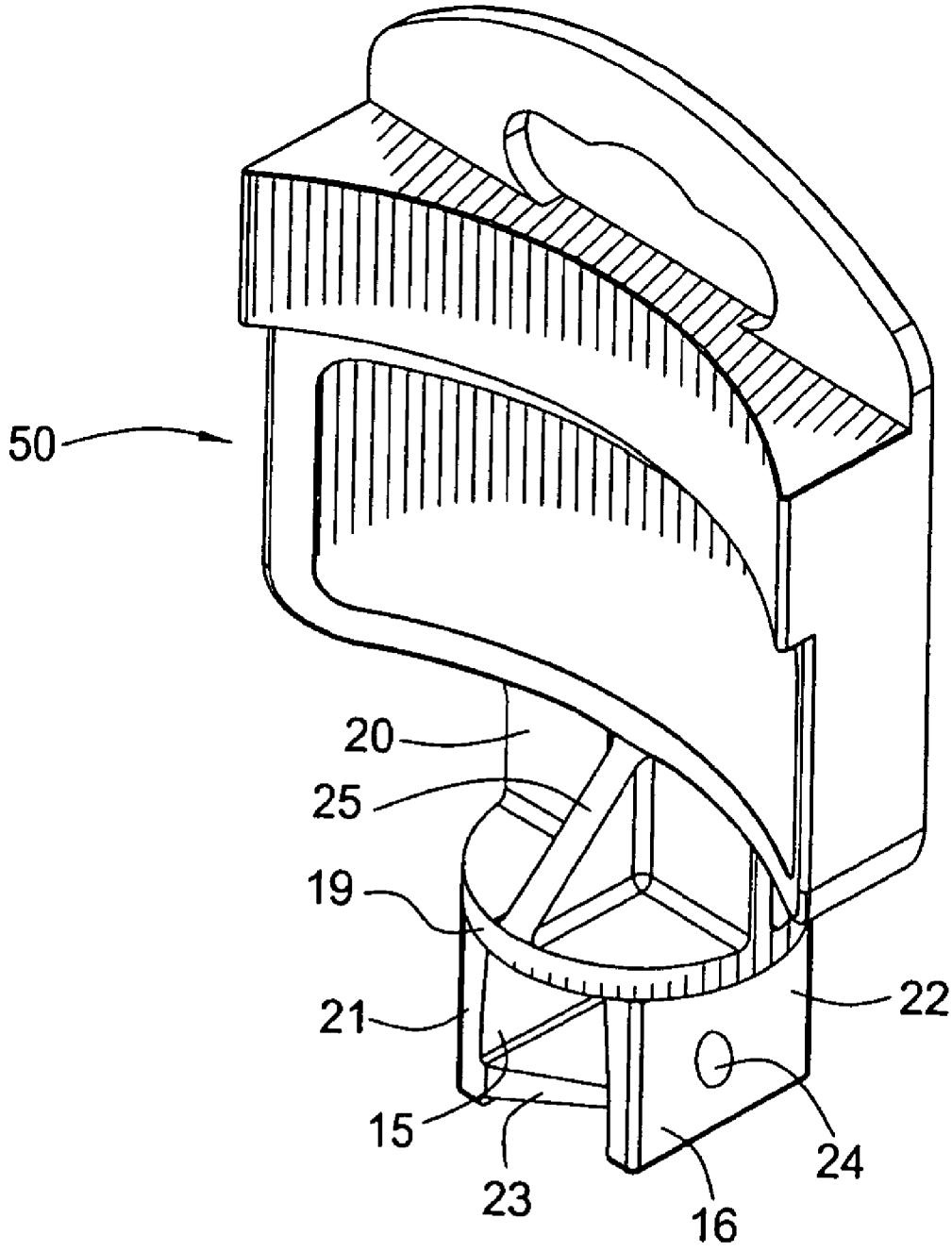
FIG. 4 illustrates a perspective view of the hangtag and the locking mechanism of FIG. 3.

FIG. 4 illustrates a perspective view of the hangtag 50 and the locking mechanism 20 of FIG. 3, without the socket 10. As shown in FIG. 4, the first and second legs, 21, 22, have a generally a rectangular profile. However, any other shaped surface, such as a curved surface can be used as the legs 21, 22 so long as the detents 24 extend further outward than any portion of the legs 21, 22, and so long as the legs 21, 22 are dimensioned to fit within the square opening 12 of the socket tool 10.

Figure 5:
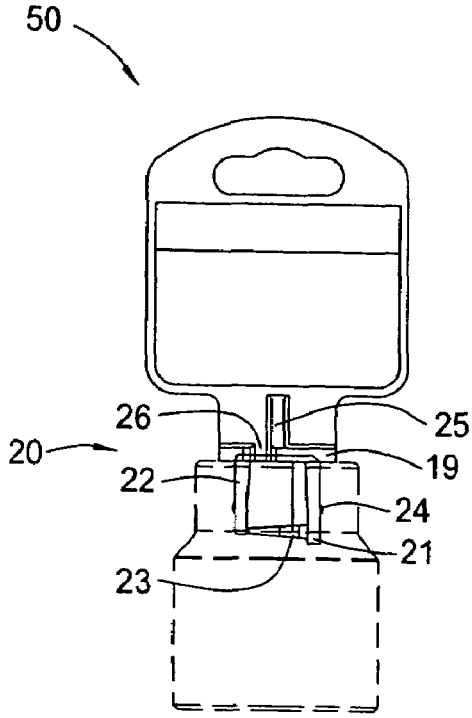
FIG. 5 provides a schematic view of a backside of the hangtag and locking mechanism of FIG. 3. The socket is shown in phantom.
Figure 6:
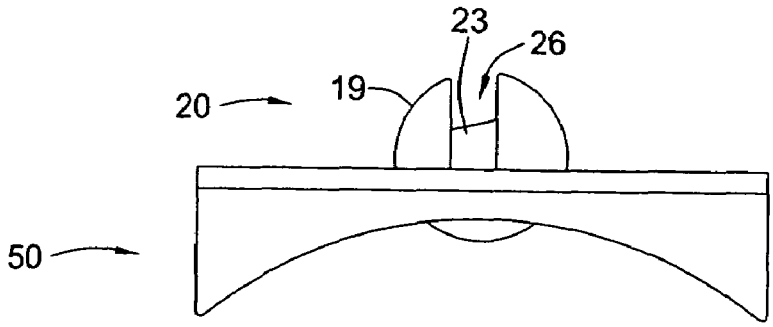
FIG. 6 shows a schematic view of a topside of the hangtag and locking mechanism of FIG. 3.

FIG. 5 provides a schematic view of a backside of the hangtag 50 and locking mechanism 20 of FIG. 3. As shown in FIG. 5, a slot 26 is disposed on the backside of the hangtag assembly 50 on the support surface 19 at an upper portion of the locking mechanism 20. The slot 26 has a rectangular profile to allow an assembly tool (at 60 in FIGS. 7A-C) to be inserted into the locking mechanism 20 and placed into contact with the spring finger 23. The slot 26 can have any profile, such as a cylindrical or elliptical profile, as long the appropriate tool can be interested through the slot 26. In the views of FIGS. 5 and 6, the slot 26 is rectangular.

FIG. 6 shows a schematic view of a topside of the hangtag 50 and locking mechanism 20. The rectangular profile of the slot 26 is clearly seen in FIG. 6. The assembly tool 60 can easily be inserted into the slot 26 to contact the spring finger 23. The slot 26 is shown having an open end on the edge of the support surface 19. The slot 26 may alternatively be manufactured as an opening fully enclosed within the support surface 19. The tapered profile of the spring finger 23 is also more clearly shown in FIG. 6.

Figure 7A:
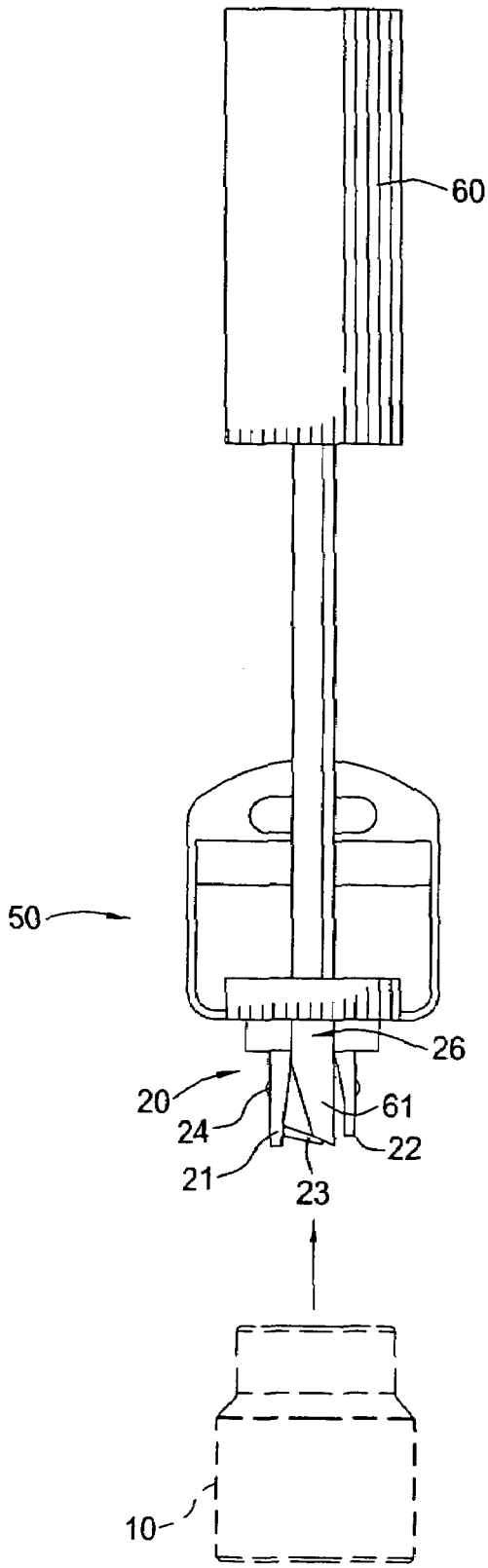
FIG. 7A provides a schematic view of the hangtag of FIG. 3, from its backside. In this view, an assembly tool is being inserted into a slot in the locking mechanism on the hangtag. This allows the legs of the locking mechanism to contract inwardly so that the locking mechanism may receive a socket.

FIG. 7A provides a schematic view of the assembly tool 60 being inserted into the locking mechanism 20 on the hangtag 50. In order to attach the locking mechanism 20 to the socket 10, the assembly tool 60 is first inserted into the top of the slot 26, as was shown in FIG. 6. The tool 60 is specifically designed for the particular hangtag use and includes a tapered end 61. The tapered end 61 of the tool 60 is placed in contact with the tapered end of the spring finger 23 to force the spring finger 23 downward. The spring finger 23 is forced downward into a second position wherein the tapered end of the spring finger 23 is below the bottom end of the second leg 22.

Figure 7B:
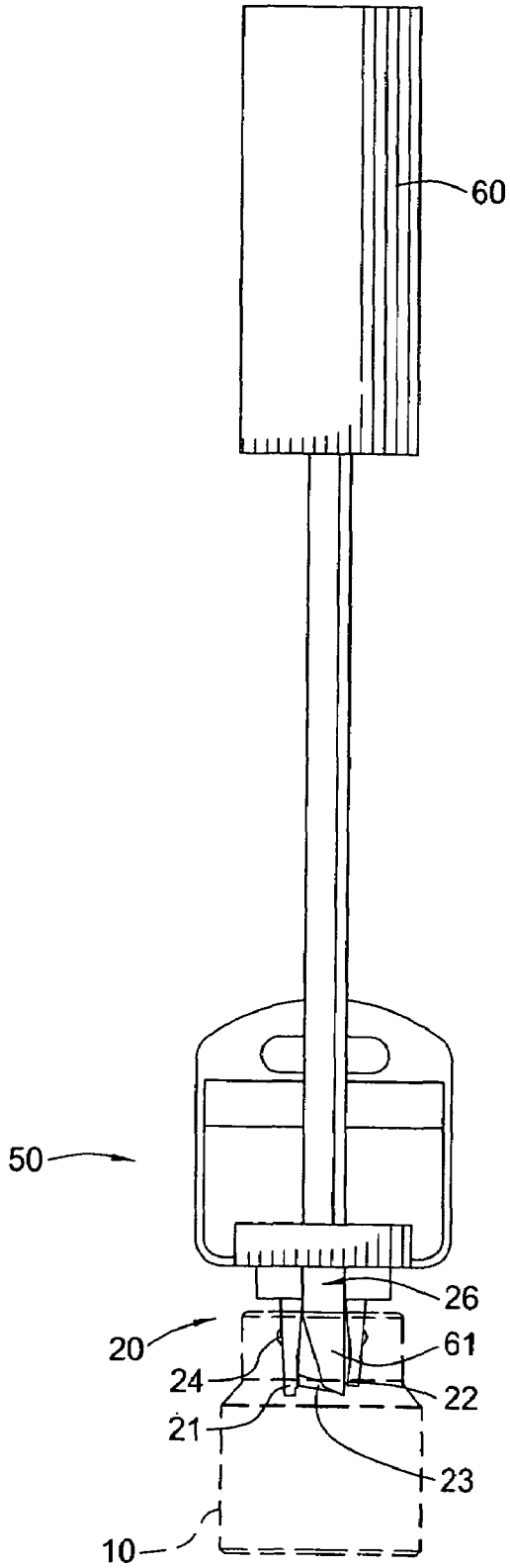
FIG. 7B shows the locking mechanism having received the socket of FIG. 7A. The socket is shown in cross-section.

FIG. 7B presents the socket 10 of FIG. 7A being connected to the locking mechanism 20. The socket 10 is shown in cross-section. The spring finger 23 has been deflected into a receiving position. The legs 21, 22 are thus allowed to contract inwardly and to then be received into the inner surface 14 of the socket tool 10. The legs 21, 22 are further bent inward as a result of the cam forces created by the interference of the detents 24 with the socket 10. Once the detents 24 are positioned at their respective undercut 13, the detents will mate with the undercuts 13, thereby allowing the legs 21, 22 to return to their original position.

Figure 7C:
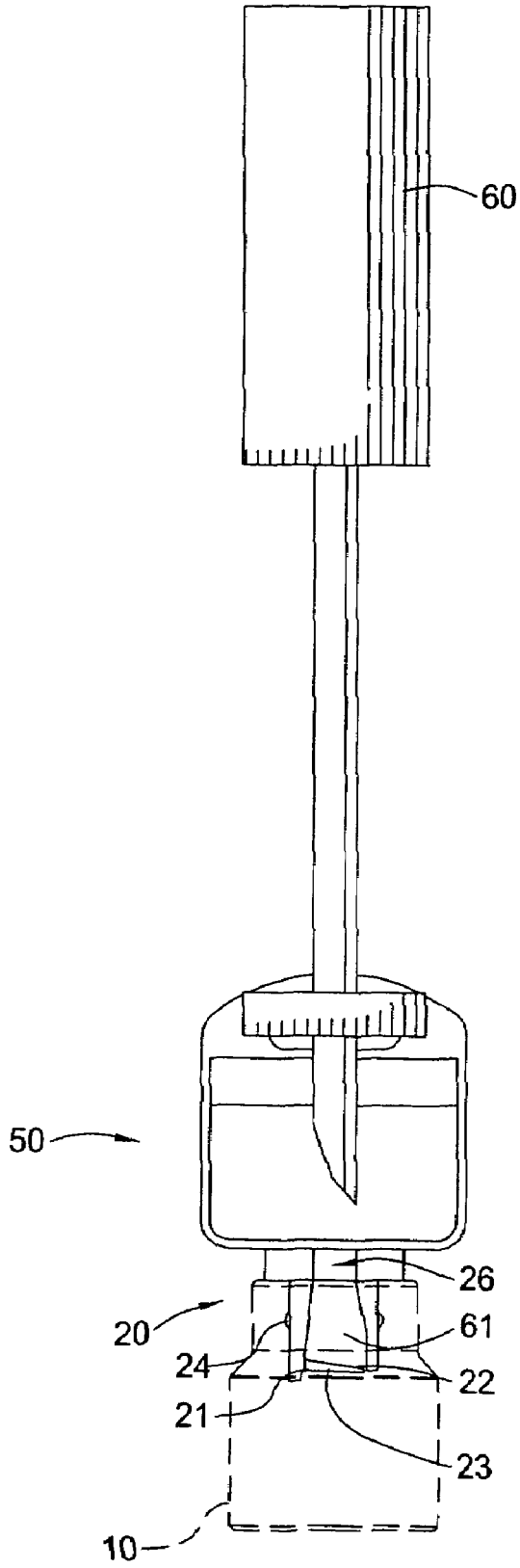
FIG. 7C shows the locking mechanism subsequent to the removal of the assembly tool from the slot. The socket is shown fully engaged with the locking mechanism.

FIG. 7C shows a schematic view of the locking mechanism subsequent to the removal of the assembly tool from the slot. Accordingly, as the assembly tool 60 is removed from the slot 26, the spring finger 23 will spring back to its original position. The spring finger 23, now again in contact with the second leg 22, will prevent the legs 21, 22 from moving inwards, thereby locking the detents 24 within their respective socket undercut 13. As a result, the socket tool 10 is locked to the hangtag 50. The spring finger 23 and the second leg 22 are preferably designed to undergo only elastic deformation during the locking of the socket tool 10 to the hangtag 50. Since the spring finger 23 and the second leg 22 have not undergone plastic deformation, the spring finger 23 and second leg 22 may return fully to their original position once the assembly tool 60 is removed from the slot 26 within the locking mechanism 20.

Once the socket tool 10 is desired for use or it has been purchased by a customer, the socket tool 10 can be "unlocked" or removed from the hangtag 50 by inserting a small screwdriver or similar tool (not shown) into the slot 26. In this respect, the original assembly tool 60 need not be used to "unlock" the socket tool from the hangtag 50, but any screwdriver or narrow shaft will suffice. The spring finger 23 can once again be deflected downward by the screwdriver to an extent that causes the spring finger 23 to plastically deform or even to break off from the first leg 21. Since the spring finger 23 is no longer in contact with at least the second leg 22, the legs 21, 22 have the freedom to bend inwards. The socket tool 10 and the hangtag 50 can now be pulled in opposite directions. Once the detents 24 are released from their respective socket undercut 13, the detents 24 will force the legs 21, 22 inwards, thereby allowing the socket tool 10 and the hangtag 50 to be separated.

Although the spring finger 23 has either been deformed plastically or broken off and no longer serves to prevent the legs 21, 22 from flexing inward, the socket tool 10 can still be securely reattached to the locking mechanism 20 on the hangtag 50 by the supporting force provided by only the legs 21, 22. The stiffness of the legs 21, 22 and the interaction between the detents 24 and their respective undercut 13 provide the frictional and engaging force required to support the socket tool 10 from the hangtag. Therefore, the socket tool 10 can be reattached to the hangtag 50 for permanent storage. The socket tool 10 can also be hung on a wall by the through-opening 53 for display or organization.

According to another embodiment of the present invention, the legs 21, 22 are biased outwards relative to each other. In this particular embodiment, the locking mechanism 20 would not require a spring finger 23 to secure the socket 10 onto the hangtag 50. Accordingly, the legs 21, 22 would be designed with a sufficient outward bias in order to provide an adequate amount of force to the inner surface 14 of the socket 10, thereby securing the socket 10 onto the hangtag 50. However, a spring finger 23 may be incorporated within this particular embodiment of the present invention to provide reinforcement to the legs 21, 22. In order to attach the socket 10 to the locking mechanism, the legs 21, 22 are first held in a normal position relative to support 19 and prevented from bending outward. The legs 21, 22 are then inserted into the socket 10 and allowed to impart the outward force resulting from the bias to the inner surface 14 of the socket 10, thereby securing the socket 10 to the hangtag 50.

In another embodiment of the invention, the legs 21, 22 are biased inwards relative to each other. This design would require the spring finger 23 to be positioned between the legs 21, 22 to, as previously described, prevent the legs 21, 22 from bending inwards relative to each other once engaged with the socket 10. The inward bias of the legs 21, 22 would allow the detents 24 on the legs 21, 22 to be more easily inserted within the square opening 12 of the socket 10.

While the foregoing is directed to embodiments of the present invention, other and further embodiments of the invention may be devised without departing from the basic scope thereof, and the scope thereof is determined by the claims that follow.

What is claimed is:

1. A hangtag assembly, comprising:

a body;

a hanging mechanism integrally formed at a first end of the body; and a supporting mechanism integrally formed at a second end of the body, the supporting mechanism comprising a support surface, first leg, second leg, and locking finger, wherein the first leg and second leg are vertically aligned with the body and the hanging mechanism, and wherein the locking finger is disposed on an inner surface of the first or second leg, and adapted to move from a first locking position to a second releasing position.

2. The hangtag assembly of claim 1, wherein the first and second legs are dimensioned to fit within an opening of a tool to be displayed by the hangtag assembly.

3. The hangtag assembly of claim 1, wherein the first and second legs are adapted to be securely received within an inner diameter or surface of a tool to be displayed by the hangtag assembly.

4. The hangtag assembly of claim 1, wherein the first end of the body is an upper end thereof and the second end of the body is a lower end thereof.

5. The hangtag assembly of claim 1, wherein at least one of the first and second legs comprises at least one detent on an outer surface thereof.

6. The hangtag assembly of claim 5, wherein the first and second legs each comprise one or more detents on an outer surface thereof.

7. The hangtag assembly of claim 5, wherein the detents are designed to engage an inner diameter of a tool to be displayed by the hangtag assembly.

8. The hangtag assembly of claim 1, wherein the locking finger protrudes from the first leg towards the second leg.

9. The hangtag assembly of claim 1, wherein the first leg is longer than the second leg.

10. The hangtag assembly of claim 1, wherein the second leg and the locking finger are each tapered at a distal end thereof.

11. A hangtag assembly, comprising:

a body;

a hanging mechanism integrally formed at a first end of the body; and a supporting mechanism integrally formed at a second end of the body, the supporting mechanism comprising a support surface, first leg, second leg, and locking finger, the locking finger disposed on an inner surface of the first or second leg, and adapted to move from a first locking position to a second releasing position, wherein the supporting mechanism further comprises an opening formed in the support surface to provide access to the locking finger.

12. The hangtag assembly of claim 11, further comprising an assembly tool adapted to fit through the opening of the support surface and contact the locking finger, thereby urging the locking finger to the second releasing position.

13. The hangtag assembly of claim 11, wherein the first end of the body is an upper end thereof and the second end of the body is a lower end thereof.

14. The hangtag assembly of claim 11, wherein the first and second legs are adapted to be securely received within an inner diameter or surface of a tool to be displayed by the hangtag assembly.

15. The hangtag assembly of claim 11, wherein the first and second legs are vertically disposed beneath the body.

16. A hangtag assembly, comprising:

a body;

a hanging mechanism integrally formed at a first end of the body; and a supporting mechanism integrally formed at a second end of the body, the supporting mechanism comprising a support surface, first leg, second leg, and locking finger, the locking finger disposed on an inner surface of the first or second leg, and adapted to move from a first locking position to a second releasing position where the locking finger in the locking position prevents inward movement of the first and second legs toward one another, and wherein at least one of the first and second legs comprises at least one detent on an outer surface thereof.

17. The hangtag assembly of claim 11, wherein the supporting mechanism further comprises an opening formed in the support surface to provide access to the locking finger.

18. The hangtag assembly of claim 17, wherein the first and second legs are vertically aligned with the body and the hanging mechanism.

* * * * *

UNITED STATES PATENT AND TRADEMARK OFFICE

CERTIFICATE OF CORRECTION

PATENT NO. : 7,603,803 B2
APPLICATION NO. : 11/582514
DATED : October 20, 2009
INVENTOR(S) : Thomas J. Wheeler and Iiya Gontar It is certified that error appears in the above-identified patent and that said Letters Patent is hereby corrected as shown below:

Title page, item (75) Liya Gontar - to be replaced by Iiya Gontar

Signed and Sealed this
Twenty-first Day of February, 2012

David J. Kappos

David J. Kappos
*Director of the United States Patent and Trademark Office*